United States Patent [19]

Martini

[11] 3,972,076

[45] Aug. 3, 1976

[54] MECHANISM FOR FLUSH SYSTEMS

[76] Inventor: Robert Joseph Ferdinand Martini, 28, rue Grimaldi, Monaco

[22] Filed: Mar. 17, 1975

[21] Appl. No.: 559,213

[30] Foreign Application Priority Data

Mar. 21, 1974 France ..... 74.09708
Feb. 3, 1975 France ..... 75.03233

[52] U.S. Cl. ..... 4/37; 4/57 R; 4/67 R

[51] Int. Cl.[2] ..... E03D 1/22; E03D 3/10

[58] Field of Search ..... 4/58, 67 R, 62, 65, 4/57 P, 57 R, 67 A, 41, 40, 26, 27, 28, 37, 34

[56] References Cited

UNITED STATES PATENTS

| | | | |
|---|---|---|---|
| 841,214 | 1/1907 | Akins | 4/27 |
| 1,501,620 | 7/1924 | Reed | 4/57 R |
| 2,714,723 | 8/1955 | Griffon | 4/26 |
| 3,553,741 | 5/1969 | Owens | 4/67 R |
| 3,613,121 | 10/1971 | McKinstry | 4/40 |
| 3,790,967 | 2/1974 | Pignato | 4/28 |

*Primary Examiner*—Henry K. Artis

[57] ABSTRACT

The mechanism for flush system to control water-draining of tanks at atmospheric pressure comprises a shutter with a resilient valve freely floating in the water of the tank, a seat for said shutter, an air-containing bell topping the shutter and provided at the upper portion thereof with an upper valve and having inner size which is larger than outer size of the resilient valve, the bell and the resilient valve being provided to enable - when the upper valve is closed, thus preventing the air inside to go out - the resilient valve to apply on the seat of the shutter thus ensuring closing of the tank which is then supplied with water while compressing the air which is in the bell, and when the upper valve is open, part of the air in the bell escapes therefrom and is replaced by some water, which releases the resilient valve from the seat of the shutter and consequently provides a draining of the tank.

10 Claims, 10 Drawing Figures

MECHANISM FOR FLUSH SYSTEMS

The flush systems especially the flush systems fitted to the toilet bowls with a siphonic action are generally provided with a water outlet closing valve controlled by a mechanism of which many parts are under water. It results therefrom corrosion problems, which have sometimes been solved in using water-resisting materials, and also formation of fur deposit which makes harder the operation of the mechanism and destroys the water-tightness of the valve.

The invention intends to cope with said disadvantages by cancelling any friction piece being in water and ensuring automatically the water tightness of the water outlet closing valve even if the water will have a tendancy to fur deposit. Besides, the invention is provided to replace the pulling mechanisms, which are often out of order or damaged, by a mere push-rod which may be remote operated if desired. Then, one of the main advantages of the invention consists in the adaptability of the mechanism of this invention to various types of water-tanks, even old, with only small changes.

The invention relates to a flush mechanism provided to control water-draining of tanks at atmospheric pressure, and comprising a shutter with a resilient valve freely floating on the water of the tank, a seat for said shutter, an air-containing bell topping the shutter and provided at the upper portion thereof with an upper valve and having inner size which is larger than outer size of the resilient valve, the bell and the resilient valve being provided to enable-when the upper valve is closed, thus preventing the air inside to go out- the resilient valve to apply on the seat of the shutter thus ensuring closing of the tank which is then supplied with water while compressing the air which is in the bell, and when the upper valve is open, part of the air in the bell escapes therefrom and is replaced by some water, which releases the resilient valve from the seat of the shutter and consequently provides a draining of a tank.

In case a second flush is needed before the tank is filled, nothing appears since there is not the required pressure of air to raise the shutter. It is possible to cope with this disadvantage by creating a device which interlocks under a second pulse and which automatically releases when the tank is filled with water; then, the shutter can be opened by the pressure of water.

According to another feature of the invention, the upper valve placed on the bell is controlled by a tilting lever fixed to a finger cooperating with a cam fixed on a vertical rod urged back by a spring, said rod supporting a first nose cooperating with a second nose fixed to a tilting arm submitted to action of a float through a rod, whereby enabling, after a first flush, to automatically control a second flush after a complete filling of the tank.

Various other features of the invention are moreover shown in the following detailed description.

Embodiments of the invention are shown by way of nonrestrictive examples in the accompanying drawings, in which.

Figure 2:
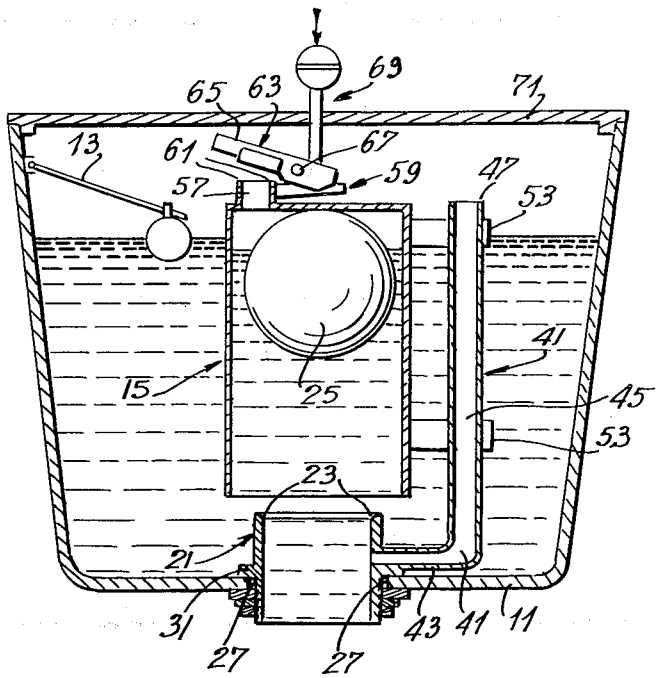
FIG. 2 is a diagrammatic view of the flush mechanism, the tank being under draining.
Figure 1:
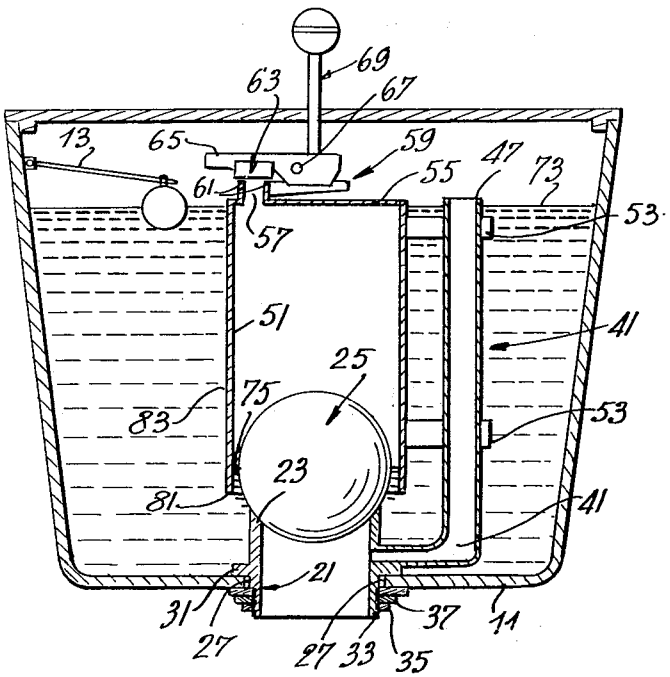
FIG. 1 is a diagrammatic view of the flush mechanism according to the invention placed in a tank, the valve being in closing position.

Referring now to FIGS. 1 and 2, in a flush tank 11 of a know type, supplied with water through an automatic water-lock of a know type, there has been placed the flush mechanism 15 according to the invention. The mechanism 15 comprises a base 21, represented by a cylinder with a circular base, of which the upper portion 23 forms a seat for a valve 25 which, in the example represented, is spherical in shape. Said valve is of resilient consistency, it can be constituted of a hollow ball with rubber wall, or of a ball made of sponge rubber. The spherical shape is not compulsory and the valve can be cone shaped or truncated cone shaped of which the tapered portion is ballasted to be constantly directed downwards and easily engaged in the base 21.

The base 21 is placed at the lower portion of the flush tank 11 by know means. In the example represented on the drawings, the base 21 passes through an aperture 27 used for the draining of the tank and is connected by a water pipe (not represented) for example to a toilet bowl. The base 21 has a flange 31 of a size larger than that of the opening 27 and centered on the same, a threading 33 outside the tank, a threaded ring 35 cooperating with the threading 33 and compressing a gasket 37 around the aperture 27. Of course two gaskets can be provided: one on each inner and outer walls of the tank and, one between the threaded ring 35 and the outer gasket of the tank; a washer or ring protecting the structure of the outer gaset during tithtening of the threaded ring 35.

The base 21 supports on its side, a rigid tube 41 communicating with the base 21 inside the tank 11 below the level of the valves 25 in an area which is never closed by this valve. The rigid tube 41 has a substantially horizontal portion 43 connected to a substantially vertical portion 45. It can however have other shapes, for example a more progressive bent, to adapt the types of tank where is placed the mechanism of the invention. The tube 41 is at its upper portion provided with an opening 47. The tube 41 has two functions: the level of the opening 47 represents the highest possible level of the water in the tank 11 and, in case the water momentarily exceeds said level, the tube 41 acts as an overflow; besides, the rigid tube 41 acts as a support for a belt 51 through adjustable and removable fixing means 53.

The bell 51 is mounted above the shutter constituted by the base 21 and the spherical valve 25 and has substantially the same centering axis. In the present case the bell is composed of a straight circular cylinder of which the inside diameter is larger than the diameter of the spherical valve 25. The bell 51 is placed in such a way that it lets a certain space free around the valve 25 when the same is in its closing position. This enables the valve 25 to leave its seat 23 and to come back on said seat without being disturbed by the bell 51. The upper portion of the bell 51 is provided with a top part 55 represented as flat in the drawings but which may take various geometrical shapes. The top part 55 has an opening 57 around which is placed a valve 59. The valve 59 comprises a seat 61 and a cap 63 coated with resilient material, for example rubber, and fixed on a flap 65 which can rotate around an axis 67 under action of a push-rod 69 which protrudes from the cover 71 of tank 11. The unit comprising the valve 59 and the push-rod 69 is placed at such a level that it is permanently out of the water even in case of an over-flow, thus preventing a deposit of fur on this unit or a water staining thereof. The place of the valve 59 on the bell 51 must be made in such a way that the valve can never be obturated by the motions of the valve 25 inside the bell.

The valve 59 and the push-rod 69 are provided with known guiding means for restricting the stroke and returning the valve to its normal close position. Thus the flap 65 can be ballasted for the cap 63 to tightly bear on the seat 61.

The herebefore described tank operates as follows:

In FIG. 1, the tank has been represented full with water up to its normal filling level 73. The automatic water lock 13 is closed. The spherical valve 25 bears on the seat 23 of the shutter. The valve 59 located on the upper portion of the bell 51 is closed. The bell is filled with air above a level 75 reached by the water inside it. Then, in the bell closed by the valve 59 there prevails an overpressure relative to the atmospheric pressure equal to the difference of hydrostatic pressures between the water levels 73 and 75. The valve 25 is held on its seat 23 through action of said overpressure and of its own weight minus the action of the Archimedean thrust corresponding to the watered portion of the valve 25, that is to the difference of level between 75 and the seat 23. Since the valve 59 is water tight, the valve 25 remains on its seat 23. If the automatic water-lock 13 is not water tight, the rigid tube 41 acts as overflow.

In FIG. 2, the tank 11 has been represented upon draining. The push-rod 69 has acted on the valve in raising up the flap 65. During a pretty short period, the air contained in the bell 51, which was slightly compressed, has rapidly been released from the bell and has been replaced by water from the tank 11. The levels of the water inside and outside the bell become about the same. The valve 25 has been raised by the motion of the water from its seat 23, which enables a draining of the tank, and freely floats inside the bell. When the tank 11 has been emptied to the approximative level of the seat 23, the valve 25 comes back on its seat where it is pressed by its own weight. At that moment, the water brought by the automatic water-lock 13, which has been open by the decrease of the level of water in the tank, is held by the shutter, and the level of the water begins to go up. This level will stop at the designed height by the closing of the automatic water-lock 13. As soon as the level of the water reaches the edge 81 of the skirt 83 of the bell 51, the air contained in the chamber starts to be compressed, if however in the meantime the valve 59 has been closed (it is only necessary therefor to release the action on the push-rod 69). Progressively there comes back the situation shown in FIG. 1.

In a type of mechanism for flush system according to the invention, there have been found the following sizes.

Inside diameter of the cylindrical bell 51: about 7.5 cm.

Height of the bell 51: from 15 to 22 cm depending on the available height of the tank.

Valve in the shape of a hollow spherical ball made of rubber; about 7 cm diameter.

Diameter of the opening 61 of the top of the bell 57: about 1.5 cm.

Ballast of the flap 65: about 30 g.

The mechanism of the invention can be used on various types of tanks. To adapt it, it is only necessary to possibly trim the edge 81, the opening 47 and to adjust the fixing means 53 of the bell 51 on the rigid tube 41. If the series of apparatus is important, parts can be manufactured at suitable sizes. In that case, the device according to the invention is very simple to place as it consists only in tightening a joint.

The fixing means 53 of the bell 51 of the tube 41 must be dismantlable to enable the above described adjustment, and also to possibly replace a valve 25 which would be found as defective. This is a non frequent case because there is no friction of the valve on its seat and, the valve being resilient, the water tightness is always ensured.

It is possible to provide other controls of the present mechanism than a hand operated push rod. Especially remote action rod controls — for example through pressure on a pedal — electrical or mechanical controls, which may eventually be time-delayed and cyclic can be used.

As shown in FIGS. 3 - 6, the flush tank 100 of a known type is supplied with water through an automatic water lock 101 of a known type and this tank is normally fitted behind a toilet bowl.

The mechanism 102 comprises a base 103 represented in the present case as a straight cylinder whose upper portion 104 forms a seat for a valve 105 which, as in FIGS. 1 and 2, is spherical. The valve 104 is of a resilient consistency and can be constituted of a hollow ball, with its wall made of rubber, or of a plain rubber ball.

The spherical shape is not compulsory as it has been explained in the above disclosure.

The base 103 is normally connected in a well-known way to a toilet bowl. There is also an overflow 106. Above the valve 105 there is placed a cylindrical sleeve 107 closed by a cover thus forming a bell.

Figure 6:
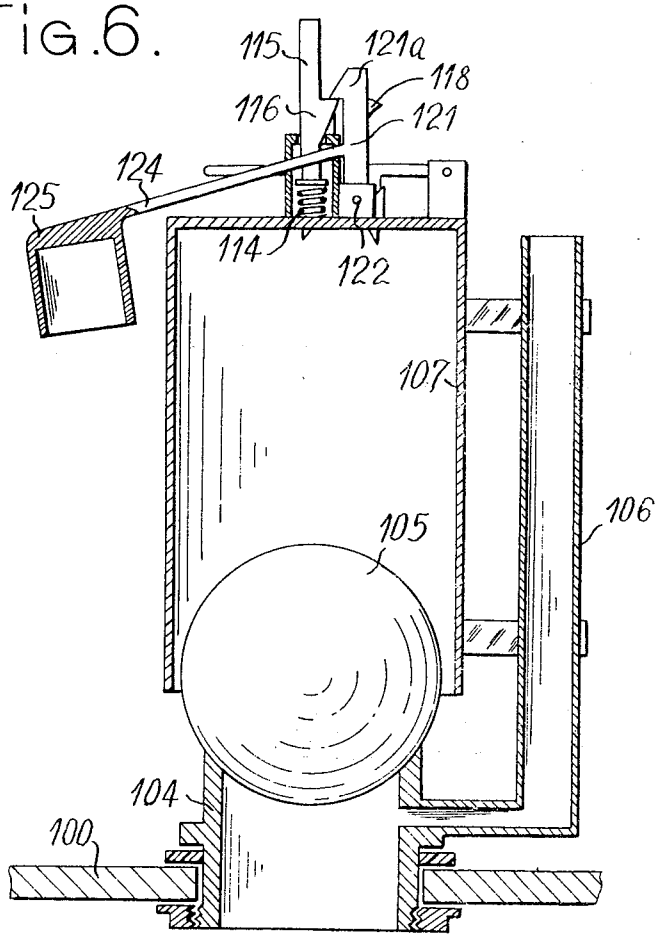
FIG. 6 is the enlarged view of FIG. 5 with the flush mechanism upon automatic operation of a second flush.
Figure 5:
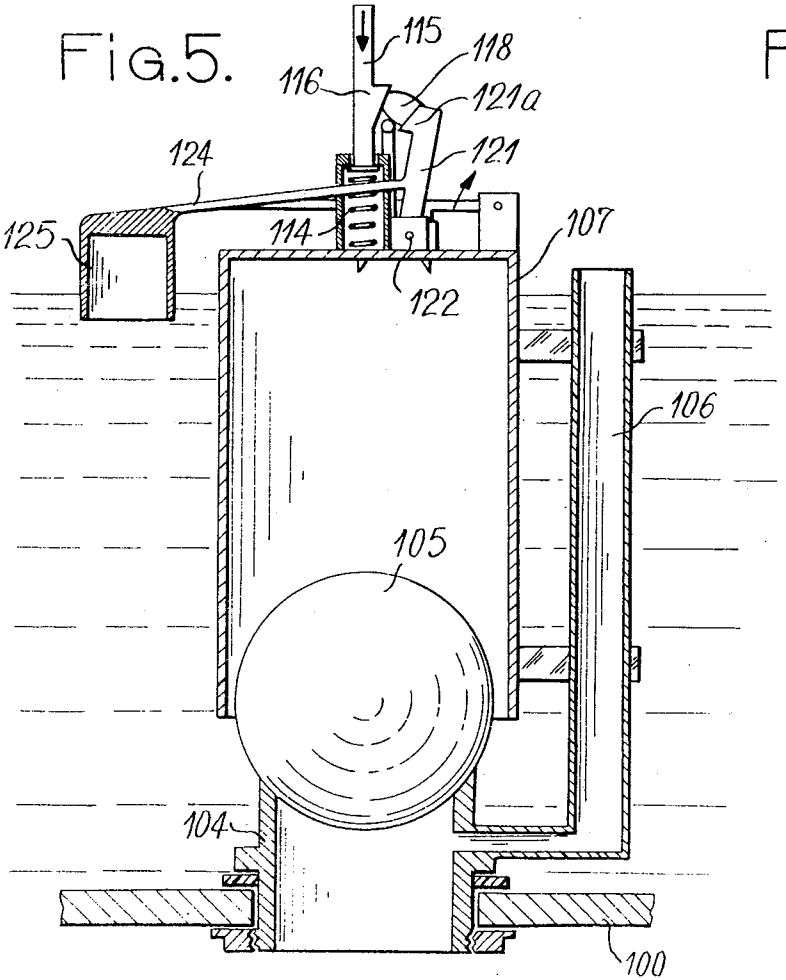
FIG. 5 is an enlarged view of a portion of FIG. 4.
Figure 9:
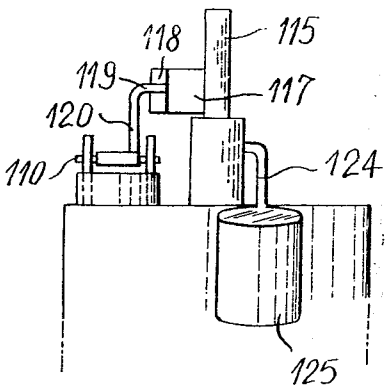
FIG. 9 is a lateral elevation view corresponding to FIG. 7.
Figure 10:
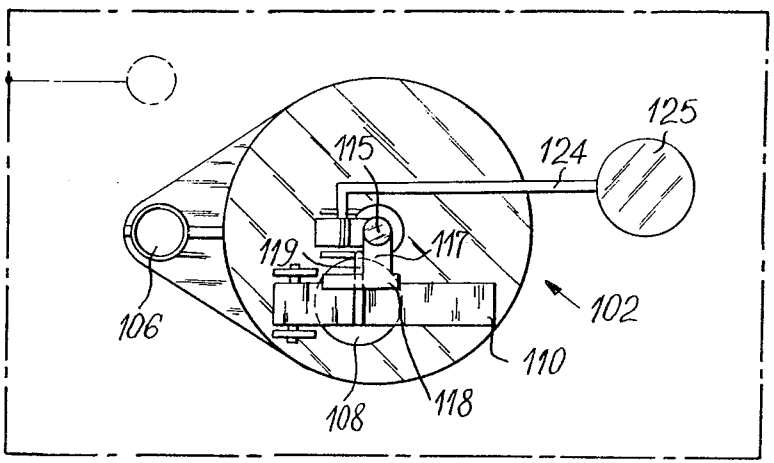
FIG. 10 is a plane view corresponding to FIG. 9.
Figure 7:
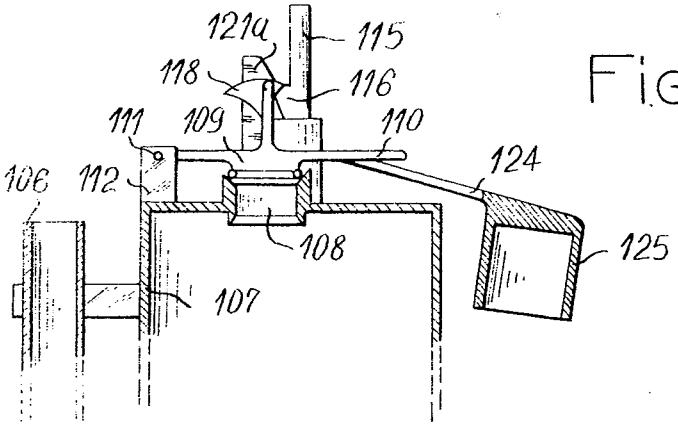
FIG. 7 is a partial cross-section elevation view taken from the rear side of FIG. 6.
Figure 8:
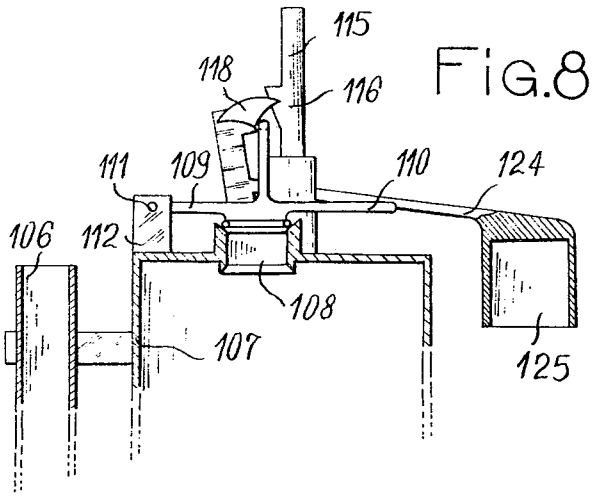
FIG. 8 is a partial cross-section elevation view taken from the rear side of FIG. 3.

As better seen in FIGS. 5 and 6, the top of the bell 107 supports a small cylinder **115*a* containing a spring 114 pushing back a rod 115 which comprises a lateral nose 116. Besides, the top of the bell 107 is provided with a sleeve 108 putting the inside of the bell in communication with the atmosphere. The sleeve 108 is normally closed by a cap 109 (FIGS. 3 and 4) fixed to a tilting lever 110 pivotally mounted on a spindle 111 placed on a support 112 fixed on top of the bell 107.**

Perpendicularly to the lateral nose 116, a part 117 supporting a cam 118 is fixed on the rod 115. Besides, a swiveling arm 121 is hinged at 122 on a support fixed to the top of the chamber 107, this swivelling arm 121 having a nose 121a designed to cooperate with the nose 116 of the rod 115. The swivelling arm 121 also supports, in its central area, a rod 124 holding at its free end, a float 125. A support 120 (FIG. 3) fixed on the lever 110 supports a finger 119 cooperating with the cam 118.

The mechanism then operates in the following way:

When the tank (FIG. 4) is full with water and if it is desired to clean the toilet bowl, a small pressure is applied on the rod 115 in direction of arrow $F_1$. This movement causes, when the rod 115 is released (said rod being pushed back by the spring 114) through the cam 118, a slight motion of the finger 119 fixed to the support 120 and, consequently a slight raise of the rod 110 and also the raise of the cap 109 from the seat 108. The air of the bell 107 is released. The valve 105 is pushed back by the pressure of the water contained into the tank 100, said tank becomes emptied through the tube 103 into the toilet bowl as explained in relation with FIGS. 1 and 2. When the tank 100 is empty the water-lock 101 releases the water, as it is known, and since the spherical valve 105 has come back on the tube 103 due to gravity, the tank is being filled again with water.

Figure 3:
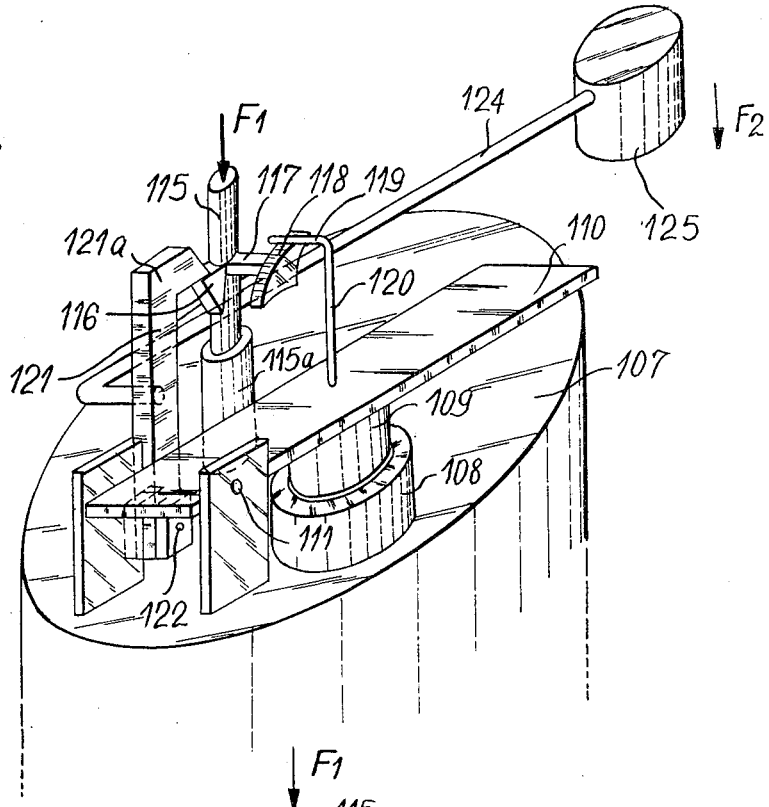
FIG. 3 is a perspective view of a variant of the flush mechanism of FIGS. 1 and 2.
Figure 4:
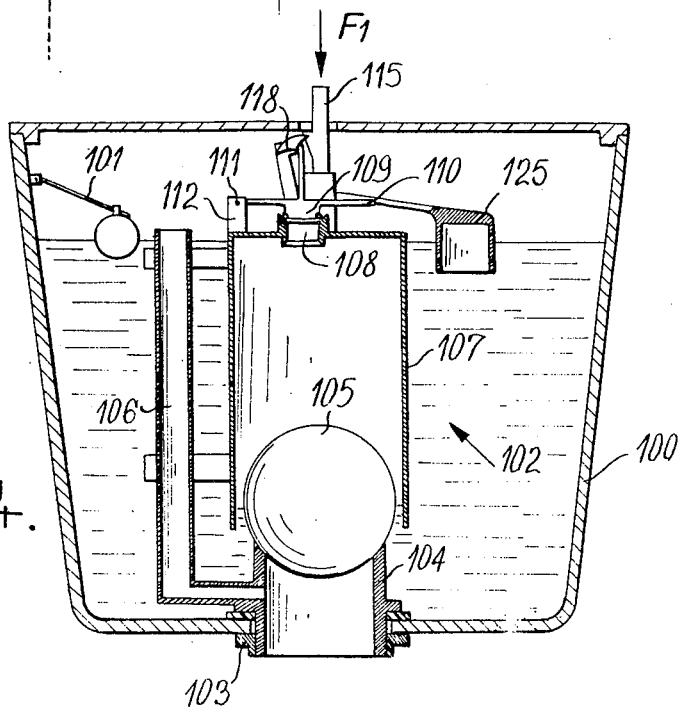
FIG. 4 is a sectional view-elevation of a tank provided with the flush mechanism of FIG. 3.

But if a second flush is necessary, it is compulsory to normally wait until filling of the tank 100. Yet, in this present case, if a pressure is again applied on the rod 115 in direction of the arrow $F_1$ against action of the spring 114, this causes blocking of said rod 115 in down position (FIG. 6). Actually, the nose 121*a* is hooked on the nose 116 since the nose 121*a* is rotated in direction of the arrow $F_2$ under effect of the weight of the float 125. Consequently, both the rod 115 and the cam 118 are pushed at the same time; thus the finger 119 is placed above this cam 118 (FIG. 3).

As soon as the tank is filled, the float 125 again rotates the finger 121 in the position represented in FIG. 5, thus releasing the rod 115 which goes up under effect of the spring 14. The cam 118 then goes up and raises, through the unit 119 – 120, the lever 110 which raises, in its turn, the cap 109, and the water flows again into the toilet bowl. Afterwards the unit returns to the position shown in FIG. 4, when the tank 100 is filled through the automatic water-lock 101.

Although this has not been specifically stated all the parts of the mechanism may be made of plastics.

I claim:

1. In a flushing mechanism for controlled draining of a water tank at atmospheric pressure, the improvement comprising:

a shutter valve including a resilient valve member freely floatable in the water of the tank, and a seat for said valve member;

an air-containing bell disposed over said shutter valve, said bell having a lower open end and an upper closed end and dimensioned to permit free movement of said valve member within said bell and between said open and closed ends;

an upper valve on said upper closed end operable to selectively permit and prevent air to pass in and out of said bell; and means providing a liquid seal between said seat and said resilient valve member when said upper valve is closed preventing air inside said bell to escape;

said valve, in its open position, permitting air inside said bell to escape, thereby allowing entry of water into said open end of said bell and causing said resilient valve to float upwardly releasing said resilient valve from said seat and consequently providing a draining of the tank through said shutter valve.

2. The flushing mechanism as claimed in claim 1, wherein said means providing a liquid seal includes a shaped upper edge on said seat conforming to the shape of the seated portion of said resilient valve member.

3. The flushing mechanism as claimed in claim 2, wherein said resilient valve is spherical in shape and said shutter comprises a cylindrical base for said seat.

4. The flushing mechanism as claimed in claim 2, wherein the resilient valve is cone shaped, said resilient valve being ballasted in its tapered portion, and said shutter comprises a cylindrical base for said seat.

5. The flushing mechanism as claimed in claim 1, wherein said bell is a cylinder having an axis coaxial with the axis of said shutter.

6. The flushing mechanism as claimed in claim 3, wherein said upper valve comprises a soft rubber coating; and said mechanism further includes a push-rod for opening and closing said upper valve.

7. The flushing mechanism as claimed in claim 6, further comprising an overflow tube which is connected to said base of said shutter at a level lower than that of said seat, said overflow tube including adjustable support members for supporting said bell and said push-rod.

8. The flushing mechanism as claimed in claim 1, wherein said shutter valve and said bell are made of plastics.

9. The flushing mechanism as claimed in claim 1, wherein said resilient valve is made of rubber.

10. The flushing mechanism as claimed in claim 1, wherein said upper valve includes a tilting lever fixed to a finger cooperating with a cam fixed on a vertical rod urged back by a spring for controlling operation of said upper valve, said rod supporting a first nose thereon, said mechanism further including a tilting arm and float combination, movement of said float causing tilting of said arm, said tilting arm having a second nose cooperating with said first nose, whereby, upon filling of the tank, said float moves said arm to unlatch said noses and initiate a second flushing action.

* * * * *